US008282463B2

(12) United States Patent
Aoki et al.

(10) Patent No.: US 8,282,463 B2
(45) Date of Patent: Oct. 9, 2012

(54) GAMING SYSTEM WITH QUEUED PARTIAL OUTCOMES

(75) Inventors: Dion Aoki, Henderson, NV (US); Christopher R. Barney, Henderson, NV (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 81 days.

(21) Appl. No.: 12/738,682

(22) PCT Filed: Nov. 3, 2008

(86) PCT No.: PCT/US2008/012433

§ 371 (c)(1),
(2), (4) Date: Apr. 19, 2010

(87) PCT Pub. No.: WO2009/061388

PCT Pub. Date: May 14, 2009

(65) Prior Publication Data

US 2010/0304843 A1 Dec. 2, 2010

Related U.S. Application Data

(60) Provisional application No. 61/002,104, filed on Nov. 6, 2007.

(51) Int. Cl.
*A63F 9/24* (2006.01)

(52) U.S. Cl. ..... 463/20; 463/16; 463/25

(58) Field of Classification Search ..... 463/16–20, 463/25–29

See application file for complete search history.

(56) References Cited

U.S. PATENT DOCUMENTS

| | | | | |
|---|---|---|---|---|
| 6,132,311 | A * | 10/2000 | Williams | 463/13 |
| 6,270,412 | B1 * | 8/2001 | Crawford et al. | 463/20 |
| 2002/0151349 | A1 | 10/2002 | Joshi | |
| 2003/0148804 | A1 * | 8/2003 | Ikeya et al. | 463/16 |
| 2004/0053657 | A1 | 3/2004 | Fiden et al. | |
| 2004/0053662 | A1 | 3/2004 | Pacey | |

(Continued)

FOREIGN PATENT DOCUMENTS

WO WO 2009/114472 A1 9/2009

OTHER PUBLICATIONS

Written Opinion corresponding to International Patent Application No. PCT/US2008/012433, United States Patent Office, dated Jan. 2, 2009, 2 pages.

(Continued)

*Primary Examiner* — Omkar Deodhar
(74) *Attorney, Agent, or Firm* — Nixon Peabody LLP

(57) ABSTRACT

A gaming system comprises a wager input device and at least one display for displaying a primary wagering game, the primary wagering game comprising a first portion and a second portion. At least one controller is operative to (i) detect receipt of at least two wagers from a first player via the wager input device, (ii) in response to detecting the at least two wagers, determine and display at least two respective partial outcomes of the first portion of the wagering game, (iii) store the respective partial outcomes, (iv) upon the occurrence of a triggering event, determine and display a secondary outcome of the second portion of the wagering game, and (v) combine each of the respective partial outcomes with the secondary outcome to determine and display a plurality of final outcomes.

27 Claims, 13 Drawing Sheets

U.S. PATENT DOCUMENTS

| | | | | |
|---|---|---|---|---|
| 2005/0055113 | A1 | 3/2005 | Gauselmann | |
| 2005/0124406 | A1 * | 6/2005 | Cannon | 463/20 |
| 2005/0130730 | A1 | 6/2005 | Lind et al. | |
| 2005/0282605 | A1 * | 12/2005 | Englman et al. | 463/13 |
| 2006/0084486 | A1 | 4/2006 | Belger et al. | |
| 2009/0305765 | A1 * | 12/2009 | Walker et al. | 463/20 |

OTHER PUBLICATIONS

International Search Report corresponding to International Patent Application No. PCT/US2008/012433, United States Patent Office, dated Jan. 2, 2009, 5 pages.

* cited by examiner

GAMING SYSTEM WITH QUEUED PARTIAL OUTCOMES

CLAIM OF PRIORITY AND CROSS-REFERENCE TO RELATED APPLICATIONS

This application is a U.S. National Phase of International Application No. PCT/US2008/012433, filed on Nov. 3, 2008, which claims the benefit of and priority to U.S. Provisional Patent Application No. 61/002,104, filed on Nov. 6, 2007, both of which are incorporated herein by reference in their entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having queued partial outcomes.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present method and apparatus, a method of operating a wagering game comprises receiving at least two wagers from at least a first player and in response to receiving the at least two wagers, determining and displaying at least two respective partial outcomes of a first portion of the wagering game. The method further comprises storing the respective partial outcomes, upon the occurrence of a triggering event, determining and displaying a secondary outcome of a second portion of the wagering game, and combining each of the respective partial outcomes with the secondary outcome to determine and display a plurality of final outcomes.

According to another aspect of the present method and apparatus, a gaming system comprises a wager input device and at least one display for displaying a primary wagering game, the primary wagering game comprising a first portion and a second portion. At least one controller is operative to (i) detect receipt of at least two wagers from a first player via the wager input device, (ii) in response to detecting the at least two wagers, determine and display at least two respective partial outcomes of the first portion of the wagering game, (iii) store the respective partial outcomes, (iv) upon the occurrence of a triggering event, determine and display a secondary outcome of the second portion of the wagering game, and (v) combine each of the respective partial outcomes with the secondary outcome to determine and display a plurality of final outcomes.

According to yet another aspect of the present method and apparatus, a method of operating a wagering game comprises receiving a plurality of wagers, and in response to receiving the plurality of wagers, determining and storing multiple respective individual outcomes for a community outcome. The method further comprises determining the community outcome, and combining the community outcome with each of the individual outcomes to provide a combined outcome that is evaluated utilizing a pay table of the wagering game.

Additional aspects of the present method and apparatus will be apparent to those of ordinary skill in the art in view of the detailed description of various embodiments, which is made with reference to the drawings, a brief description of which is provided below.

DETAILED DESCRIPTION

Figure 1A:
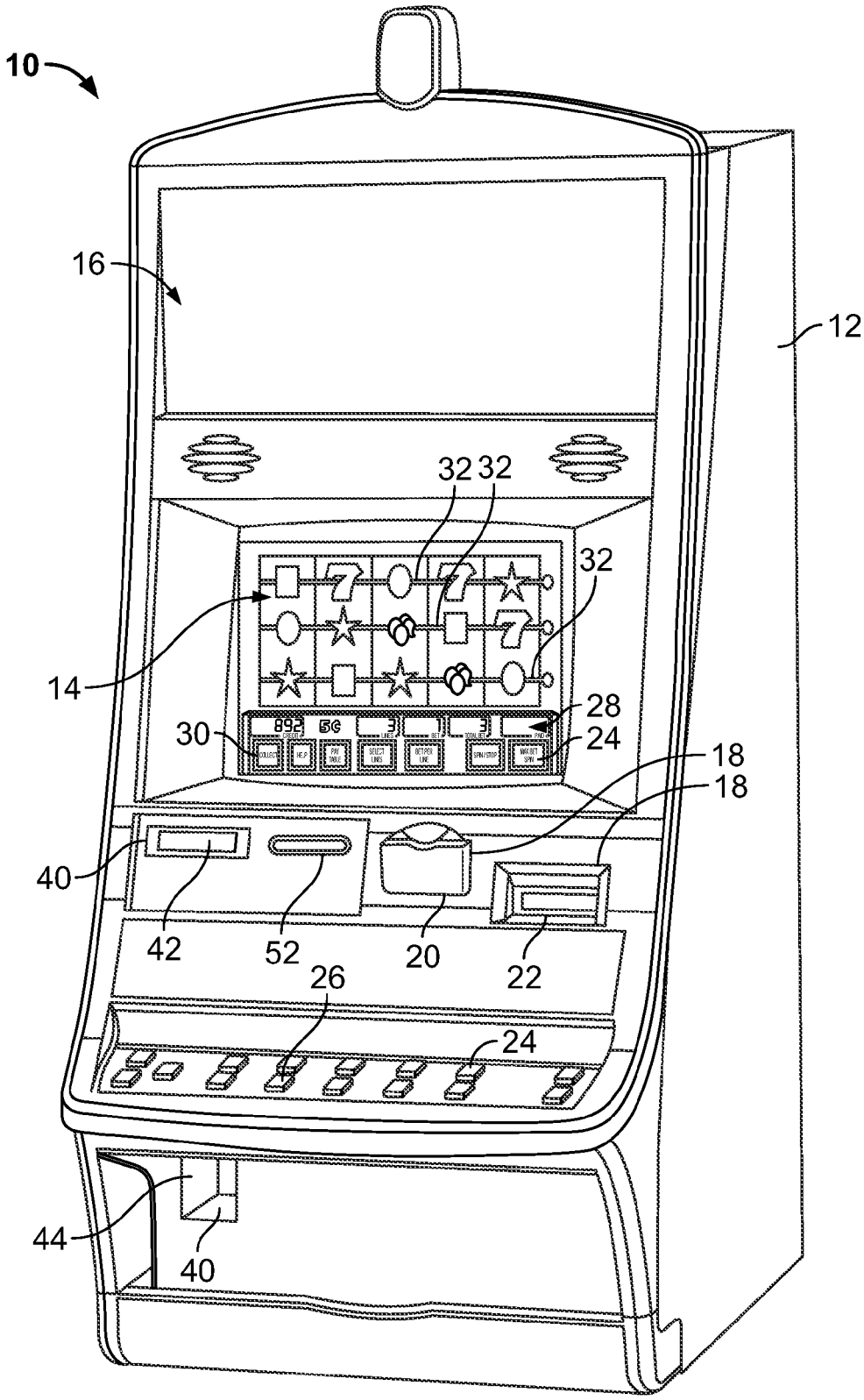
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
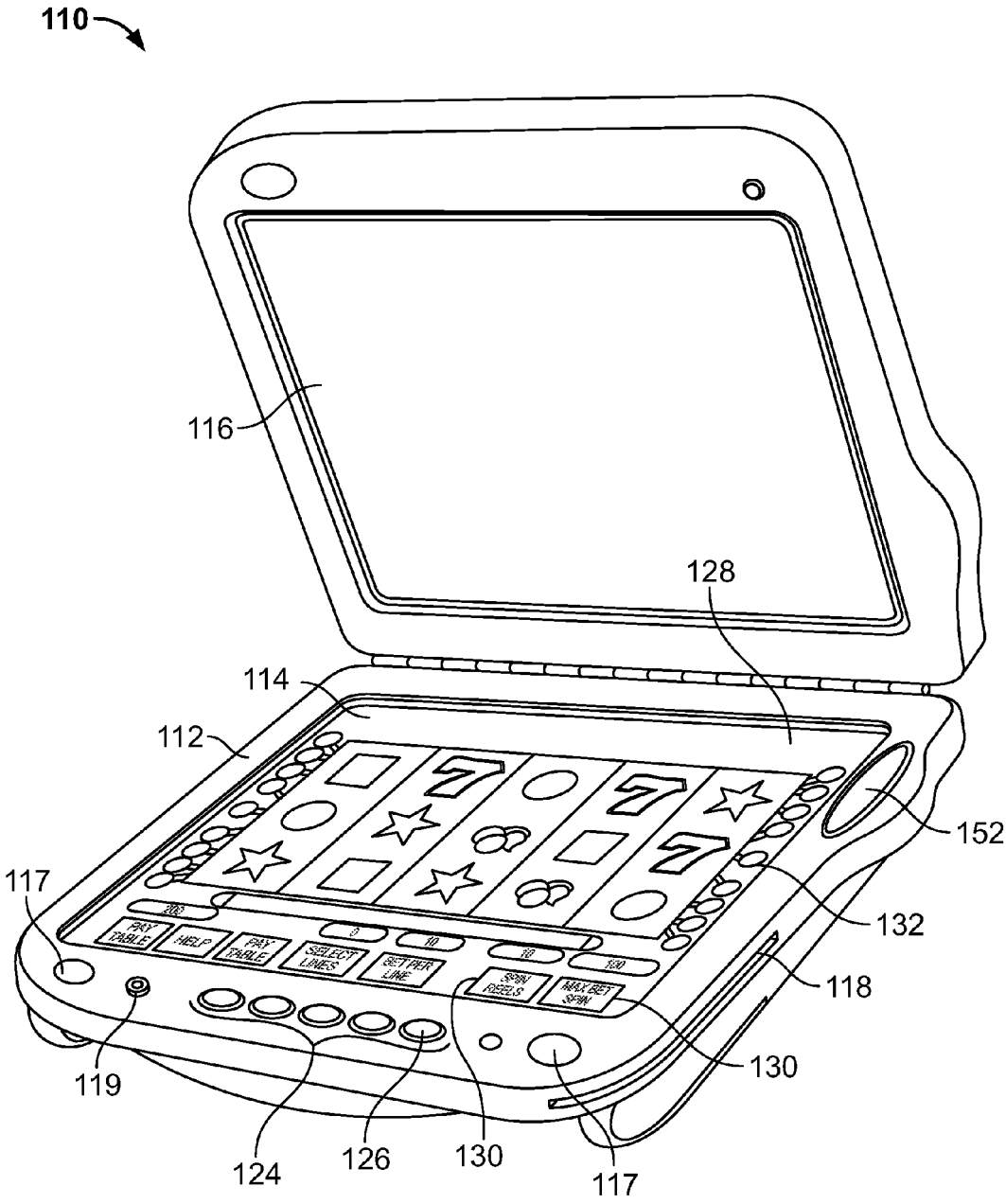
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a players account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
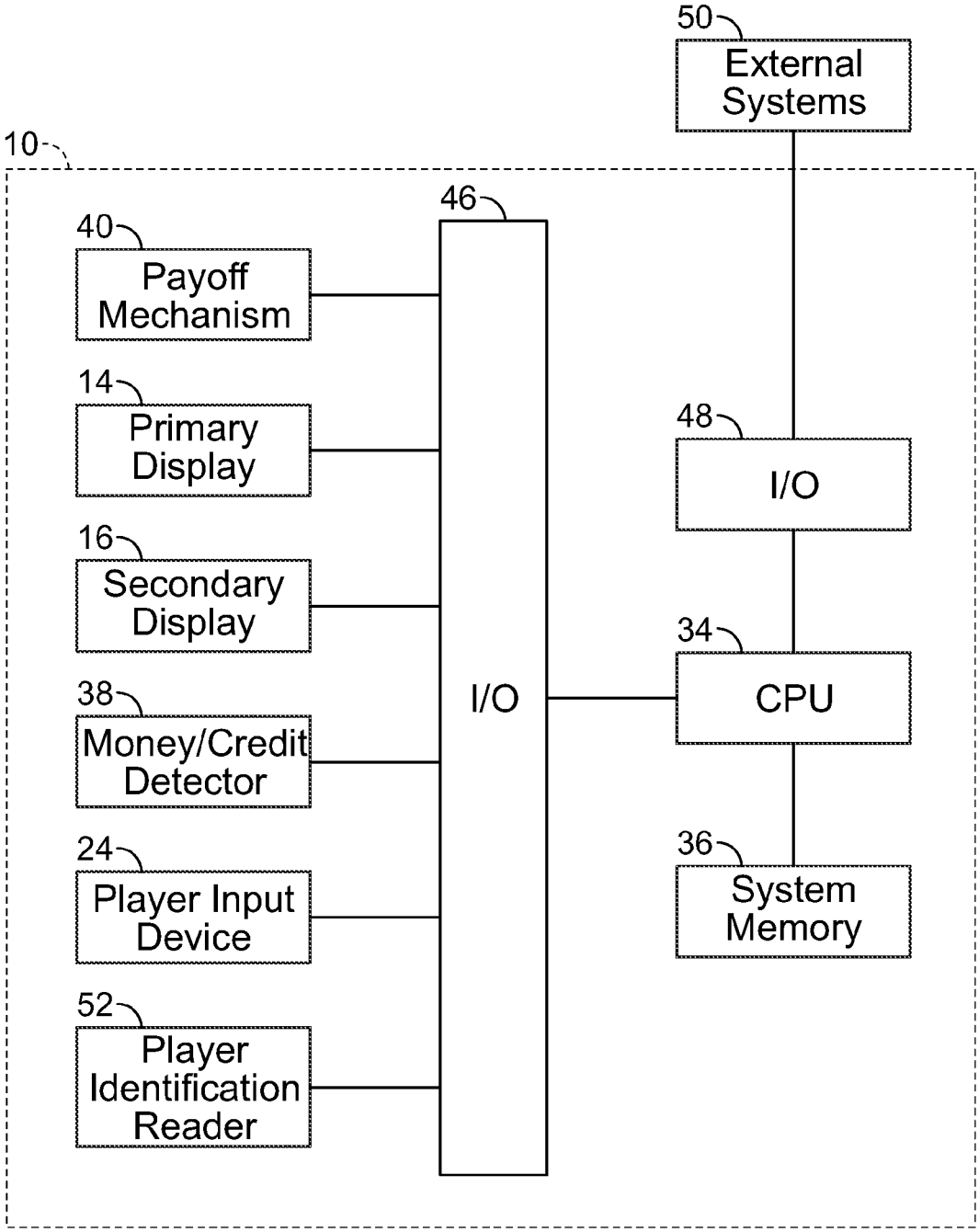
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
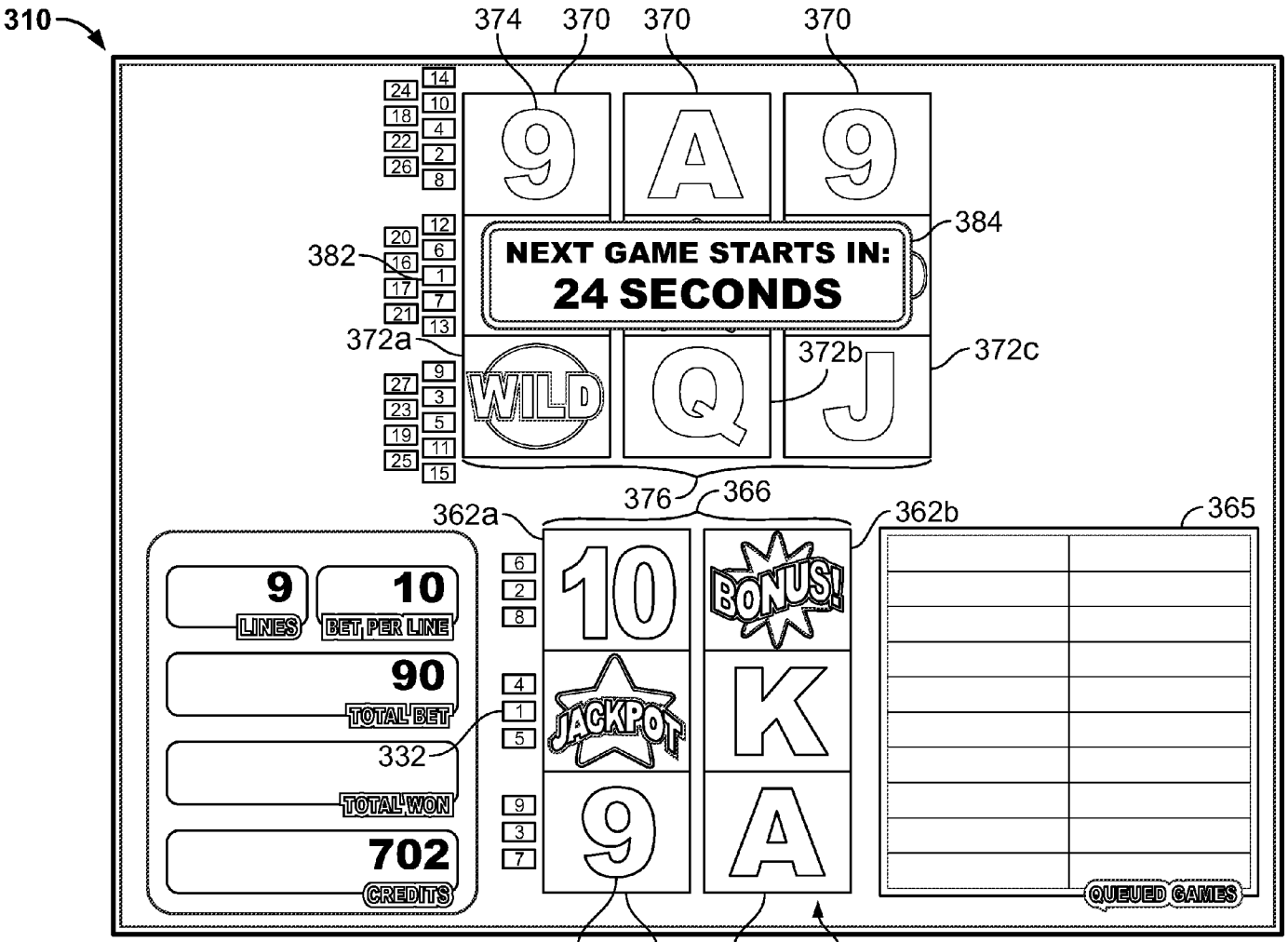
FIG. 3 is view of a gaming system displaying a primary wagering game in which a first portion of the wagering game generates queued partial outcomes which are interactive with at least one outcome of a second portion of the wagering game.

Turning now to FIG. 3, a primary display 314 of a gaming device 310 is shown. The primary display 314 may be any form of display such as those described herein with reference to the free standing and handheld gaming devices of FIGS. 1*a* and 1*b*. The primary display 314 may include display of a primary wagering game 360,370, which includes a first portion of the wagering game 360 and a second portion of the wagering game 370. The primary wagering game 360,370 in this embodiment is a slot game as shown in FIG. 3. The first portion of the wagering game 360 may include a plurality of reels, such as 362*a* and 362*b* which may be either electromechanical reels or simulations thereof on the primary display 314. The reels 362*a* and 362*b* may include a plurality of symbols 364 displayed thereon which vary as the reels 362*a* and 362*b* are spun and stopped. The symbols 364 may include any variety of graphical symbols, elements, or representations, including symbols 364 which are associated with one or more themes of the gaming machine or system. The symbols 364 may also include a blank symbol, or empty space. As described herein the symbols 364 landing on the active paylines 332 (the paylines for which a wager has been received) are evaluated for winning combinations. A combination of symbols 364 that lands on an active payline 332 is a partial outcome that is stored in a table 365. The symbols 364 on the reels 362*a* and 362*b* form an array 366 or matrix of symbols 364, having a number of rows and columns, which in the embodiment shown is three rows and two columns. In alternate embodiments, the array 366 may have greater or fewer symbols 364, and may take on a variety of different forms having greater or fewer rows and/or columns. The array 366 may even comprise other non-rectangular forms or arrangements of symbols 364.

The primary display 314 may also include display of the second portion of the wagering game 370, which in this embodiment is a slot game as shown in FIG. 3. The second portion of the wagering game 370 may include a plurality of reels, such as 372*a*, 372*b*, and 372*c* which may be either electro-mechanical reels or simulations thereof. The reels 372*a*, 372*b*, and 372*c* may include a plurality of symbols 374 displayed thereon which vary as the reels 372*a*, 372*b*, and 372*c* are spun and stopped. The symbols 374 may include any variety of graphical symbols, elements, or representations, including symbols 374 which are associated with one or more themes of the gaming machine or system. The symbols 374 may also include a blank symbol, or empty space. As described herein the symbols 374 landing on the active paylines 382 (the paylines for which a wager has been received) are evaluated with each of the stored partial outcomes in the table 365 for winning combinations. The symbols 374 on the reels 372*a*, 372*b*, and 372*c* form an array 376 or matrix of symbols 374, having a number of rows and columns, which in the embodiment shown is three rows and three columns. In alternate embodiments, the array 376 may have greater or fewer symbols 374, and may take on a variety of different forms having greater or fewer rows and/or columns. The array 376 may even comprise other non-rectangular forms or arrangements of symbols 374. In this embodiment both the first portion of the wagering game 360 and the second portion of the wagering game 370 are displayed on the same display 314, such as an LCD, plasma or other flat screen display. In an alternative embodiment, the portions of the primary wagering game 360,370 may be displayed on secondary displays. For example, a secondary display may be mounted on the housing of the gaming device 310 supporting the primary display 314, or may be remote and separate from the gaming device 310, such as a community display or overhead signage display.

Embodiments of the present method and apparatus may utilize queuing partial outcomes to be completed by a universal or community spin. For example, in a classic 5-reel game such as depicted in FIG. 3, the player may repeatedly spin the first two reels 362*a* and 362*b* of the first portion of the wagering game 360, and then the resulting partial outcomes may be completed by a single universal spin of the last three reels 372*a*, 372*b*, and 372*c* of the second portion of the wagering game 370. One example for using this feature is within a community game where the community spin occurs at predetermined times (or randomly triggered times), such as every X seconds. Some players may only want a single outcome per community spin and only place a single wager within the predetermined time period. Others may play as fast as possible making multiple wagers during the predetermined time period and accumulate numerous partial outcomes. These partial outcomes may be completed by a community spin at the end of the predetermined time period. FIG. 3 depicts the beginning of a play of the first portion of the wagering game 360. A timer display 384, stating: "NEXT GAME STARTS IN: 24 SECONDS", is overlaid on the three reels 372*a*, 372*b*, and 372*c* of the second portion of the wagering game 370 to indicate that the community portion of the game will begin at the end of that predetermined time period.

Figure 4:
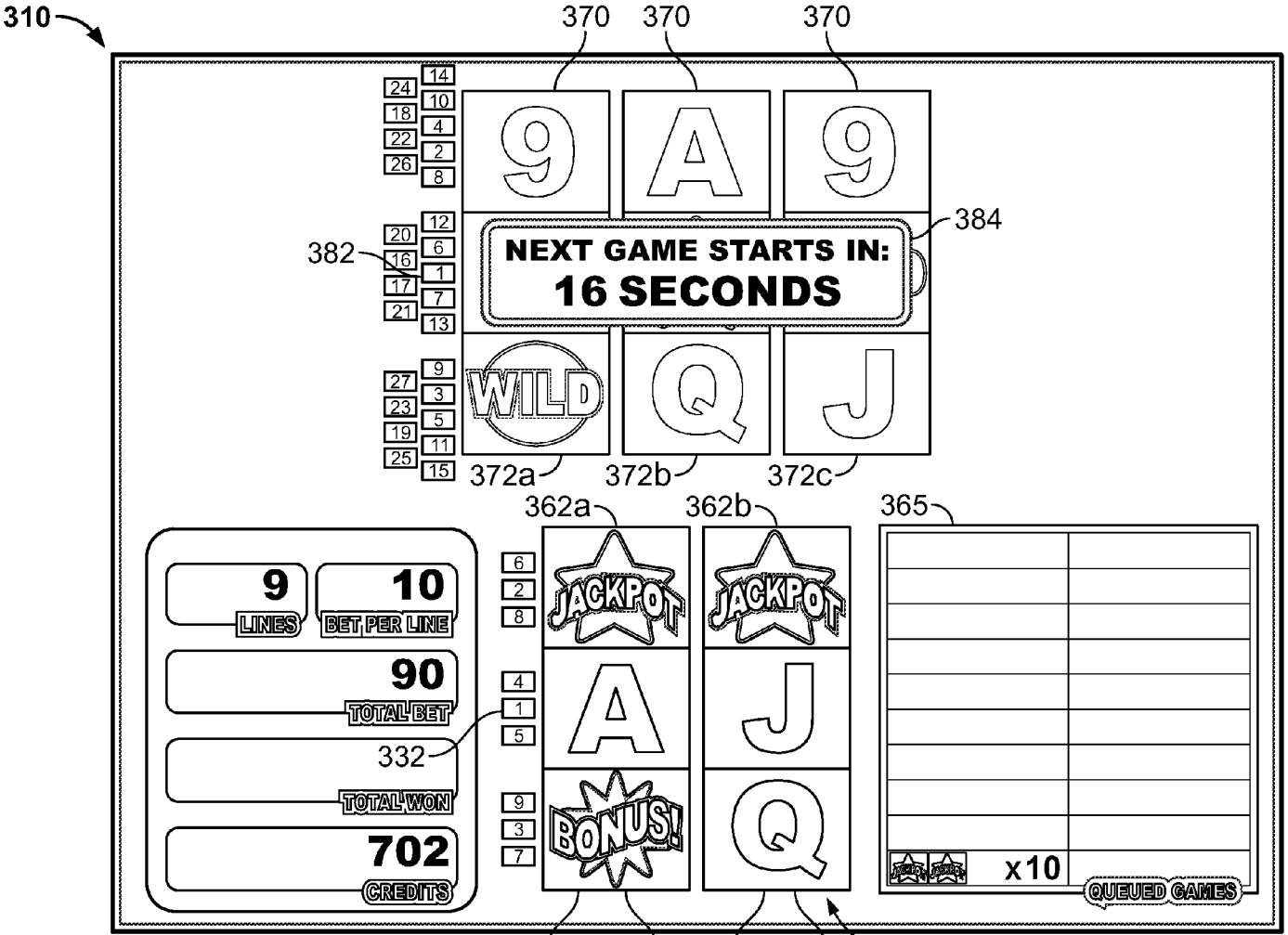
FIG. 4 is a view of the gaming system of FIG. 3, in which a portion of a first partial outcome is shown.

Turning to FIG. 4, the results of a player's spin of the reels 362*a* and 362*b* is depicted. In this example the resulting symbols are a pair of "jackpot" symbols, an ace and a jack, and a "bonus" and a queen. From these symbols a best partial outcome is selected from the player's spin of reels 362*a* and 362*b*, which in this case is the pair of "jackpot". The resulting outcomes are evaluated along the activated paylines 332. The two "jackpot" symbols partial result is stored in the table 365. Each partial outcome which is queued and stored in the table 365 may be stored along with a bet indicator. For example, the two "jackpot" symbols result is stored in the table 365 with an "×10" bet indicator which indicates that a wager of ten credits per payline was placed on the play of the first portion of the wagering game 360 which resulted in the two "jackpot" symbols outcome. Optionally, a multiplier, wild symbol, or other result enhancement may also be associated with the partial outcome and stored in the table 365. The timer display 384 now states: "NEXT GAME STARTS IN: 16 SECONDS", and is overlaid on the three reels 372*a*, 372*b*, and 372*c* of the second portion of the wagering game 370. The player may now continue to play the reels 362*a* and 362*b* and the partial outcomes are queued in the table 365.

Figure 5:
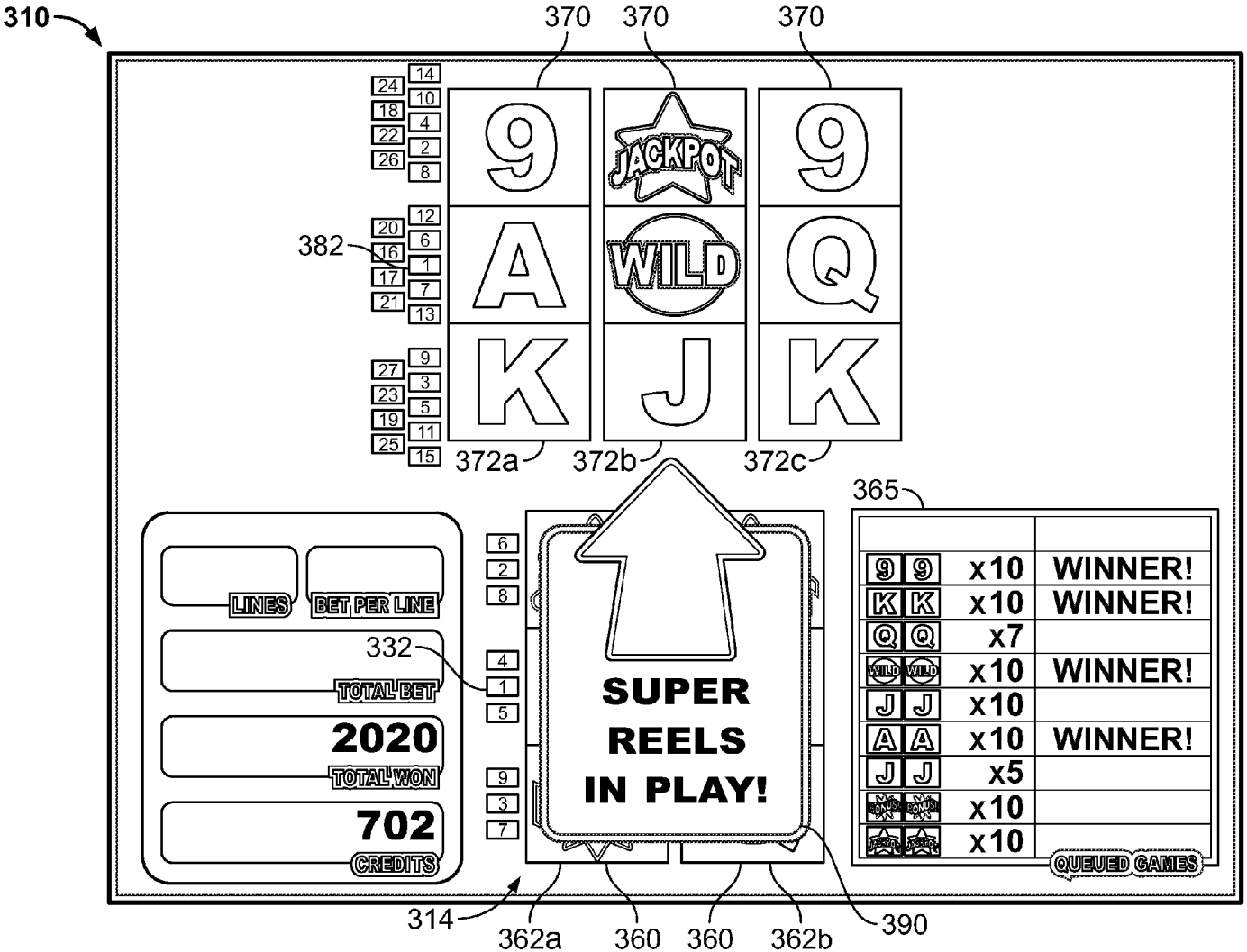
FIG. 5 is a view of the gaming system of FIG. 3, in which further queued partial outcomes are shown along with the results of combining the queued partial outcomes with an outcome of a second portion of the wagering game.

Turning to FIG. 5, the player has now completed nine spins resulting in the queuing of nine partial outcomes in the table 365. The various best partial outcomes are displayed with their associated bet indicators. When a triggering event occurs, the play of the first portion of the wagering game 360 ends and play of the second portion of the wagering game 370 commences. In this embodiment, the triggering event is the expiration of time of the predetermined time period for playing the first portion of the wagering game 360. The second portion of the wagering game 370 now takes place by an automatic spin of the reels 372*a*, 372*b*, and 372*c*. The activation of the second portion of the wagering game 370 is indicated to the player by the label "Super Reels In Play" overlaid on the primary display 314. The player can no longer spin the reels 362*a* and 362*b* of the first portion of the wagering game 360. In this embodiment after one spin of the reels 372*a*, 372*b*, and 372*c*, the stored results in the table 365 in combination with the reels 372*a*, 372*b*, and 372*c* are evaluated using all activated paylines. In this embodiment, the greatest number of paylines which can be activated are the nine pay lines passing through the partial outcomes on the first two reels 362*a*, 362*b* and the 27 additional paylines passing through the remaining three reels 372*a*, 372*b*, 372*c*. The final results may now be displayed in the table 365 showing which of the final results are "WINNERS". The resultant winning combinations are also evaluated with reference to the bet indicator for the partial outcome involved in the winning combination.

In this embodiment, the second portion of the wagering game 370 is triggered by the end of a predetermined time period. However, it is to be understood that the trigger may be, for example, time based, threshold based, or random based. In this embodiment the end of the time period may be indicated by the overlay of a message box 390 on the primary display 314.

Figure 6:
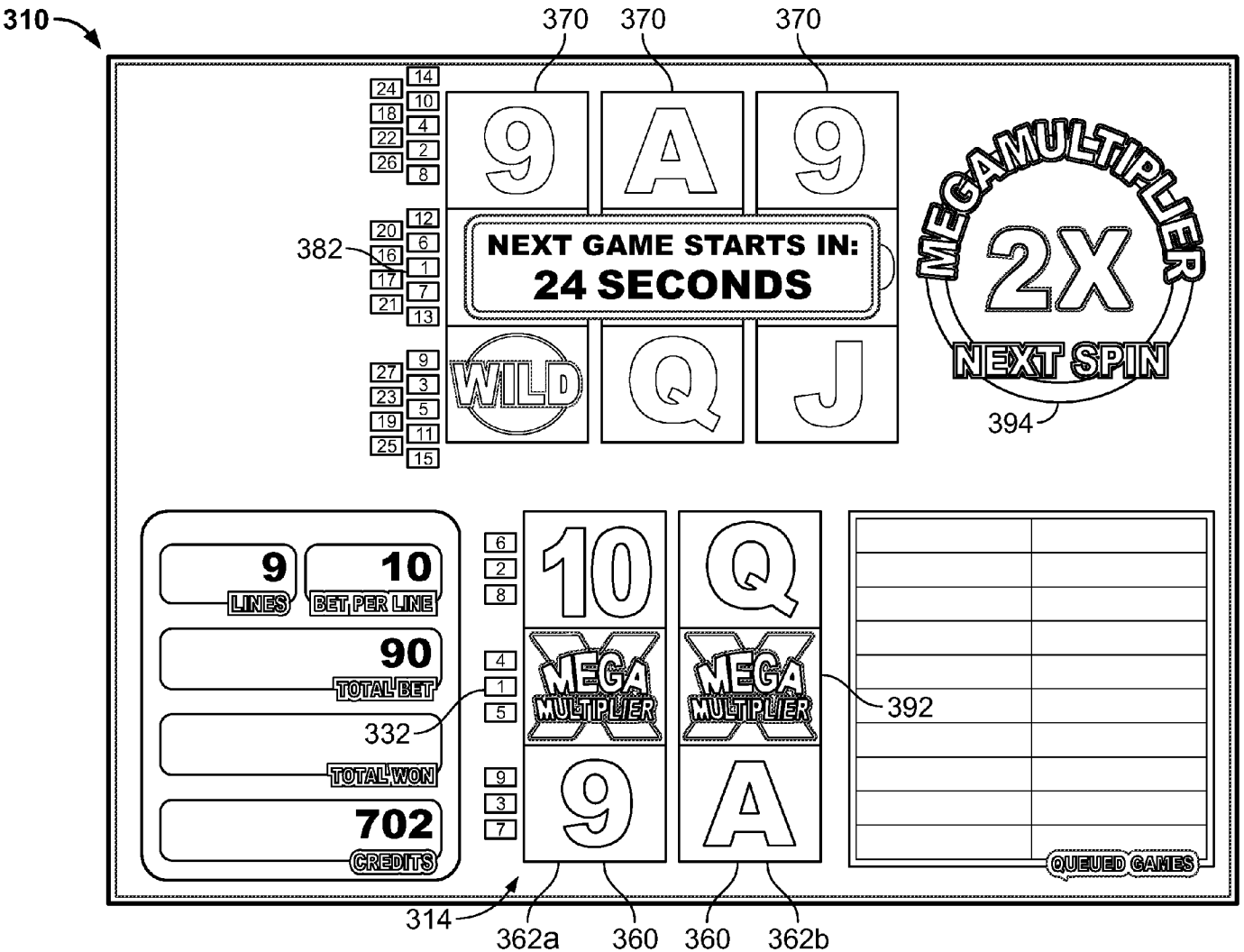
FIG. 6 is view of an alternative gaming system displaying a first portion of the wagering game in which queued partial outcomes are interactive with at least one outcome of a second portion of the wagering game.

Turning to FIG. 6, an alternative embodiment of a gaming system is depicted. In addition to accumulating partial outcomes, the player may accumulate modifiers that may award spin multipliers, bonuses, and other game modifiers such as additional wild symbols. For example, game modifiers "MEGA MULTIPLIER" may result from a spin of the reels 362*a* and 362*b*. A display region 394 then indicates to the player that results of the next spin of the reels 362*a* and 362*b* will be multiplied by "2×". In this embodiment, from each of the spin results of the reels 362*a* and 362*b* the best partial outcomes are selected. These selected partial results may be stored in the table 365. The player may repeatedly spin the first two reels 362*a* and 362*b* of the first portion of the wagering game 360, and then the resulting partial outcomes may be completed by a single universal spin of the last three reels 372*a*, 372*b*, and 372*c* of the second portion of the wagering game 370. The spin of the last three reels 372*a*, 372*b*, and 372*c* may occur after a predetermined time period, for example.

Figure 7:
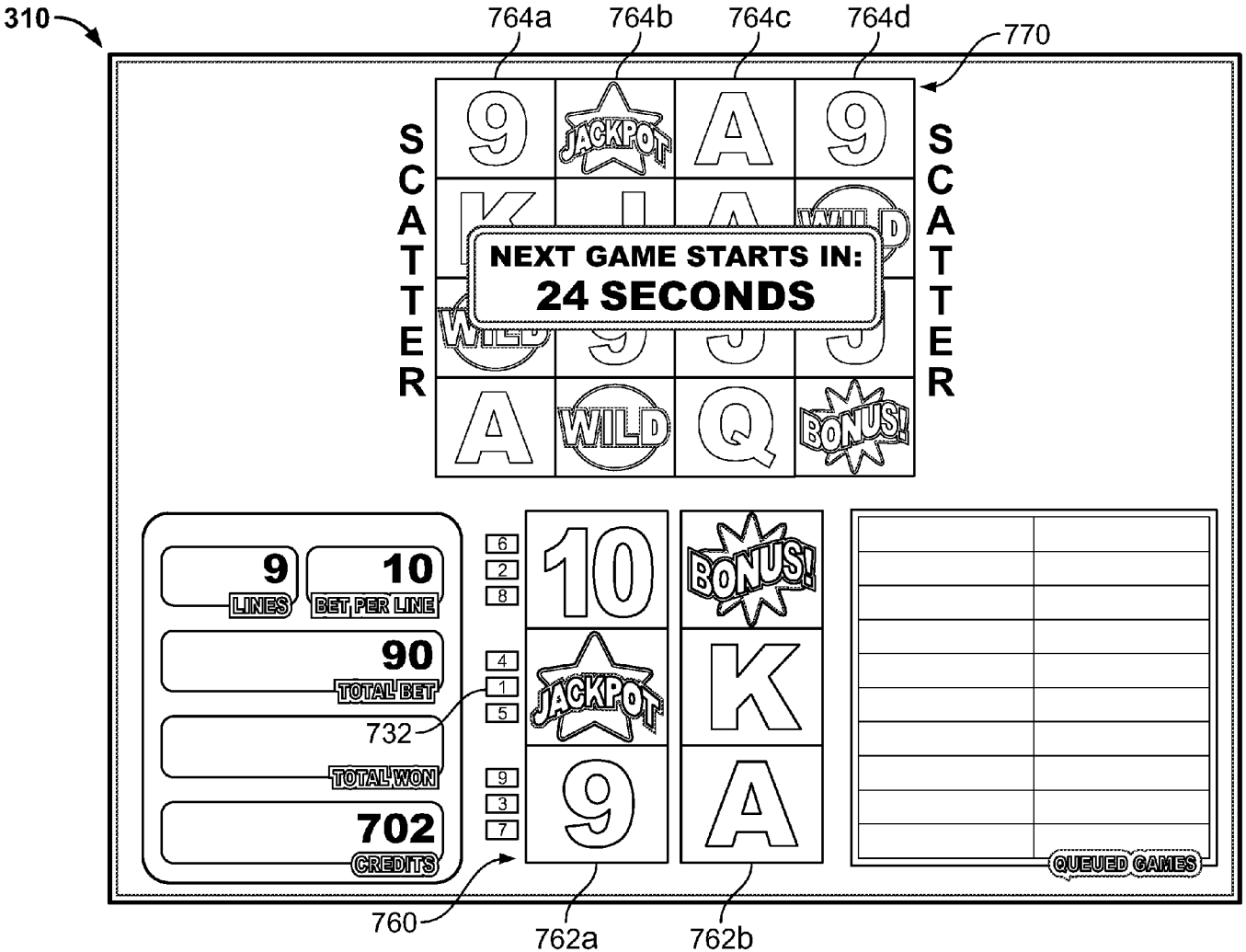
FIG. 7 is view of a further gaming system displaying a first portion of the wagering game in which queued partial outcomes are interactive with at least one outcome of a second portion of the wagering game.

Turning to FIG. 7, this embodiment is an example of a game that utilizes the first two reels 762*a* and 762*b* as line triggers and the last four reels 764*a*, 764*b*, 764*c*, and 764*d* as scatter pays. A scatter pay in slot-type games refers to a symbol combination that appears on the reels that is evaluated based upon the number of like symbols appearing in the array, and without regard to any particular alignment, such as along a payline. Thus, examples of scatter pays are 3-symbol scatter pays, 4-symbol scatter pays, etc. In some embodiments, hitting a predetermined number of scatter pay symbols in one spin may comprise a winning combination, while additional or "extra" scatter pay symbols are used to multiply or extend the player's win.

The queued partial outcomes of the first portion of the wagering game 760 are combined with the outcome of the second portion of the wagering game 770 to evaluate wins. Thus, the first portion of the wagering game 760 outcomes (based on the paylines) are stored in the table and combined with outcomes of the second portion of the wagering game 770 outcomes (which are scatter pays). In an example, the middle row of the first portion of the wagering game 760 displays "Jackpot King". Because the Jackpot symbol is a "wild" symbol, it can substitute for a "King" symbol. This creates a first portion of the wagering game 760 outcome of "King King" which is store in the table. This "2 Kings" outcome is combined with the scatter pay outcome in the second portion of the wagering game 770. The reels 764 of the second portion of the wagering game 770 show one "King" symbol (first symbol in the second row). Thus, the combined outcome is a "3 Kings" outcome for which the player is awarded a prize. The above-described partial payline, partial scatter slot play is more fully detailed in U.S. Provisional Application No. 60/937,911, filed Jun. 29, 2007, by Gomez et al., which is incorporated herein by reference in its entirety.

Figure 8:
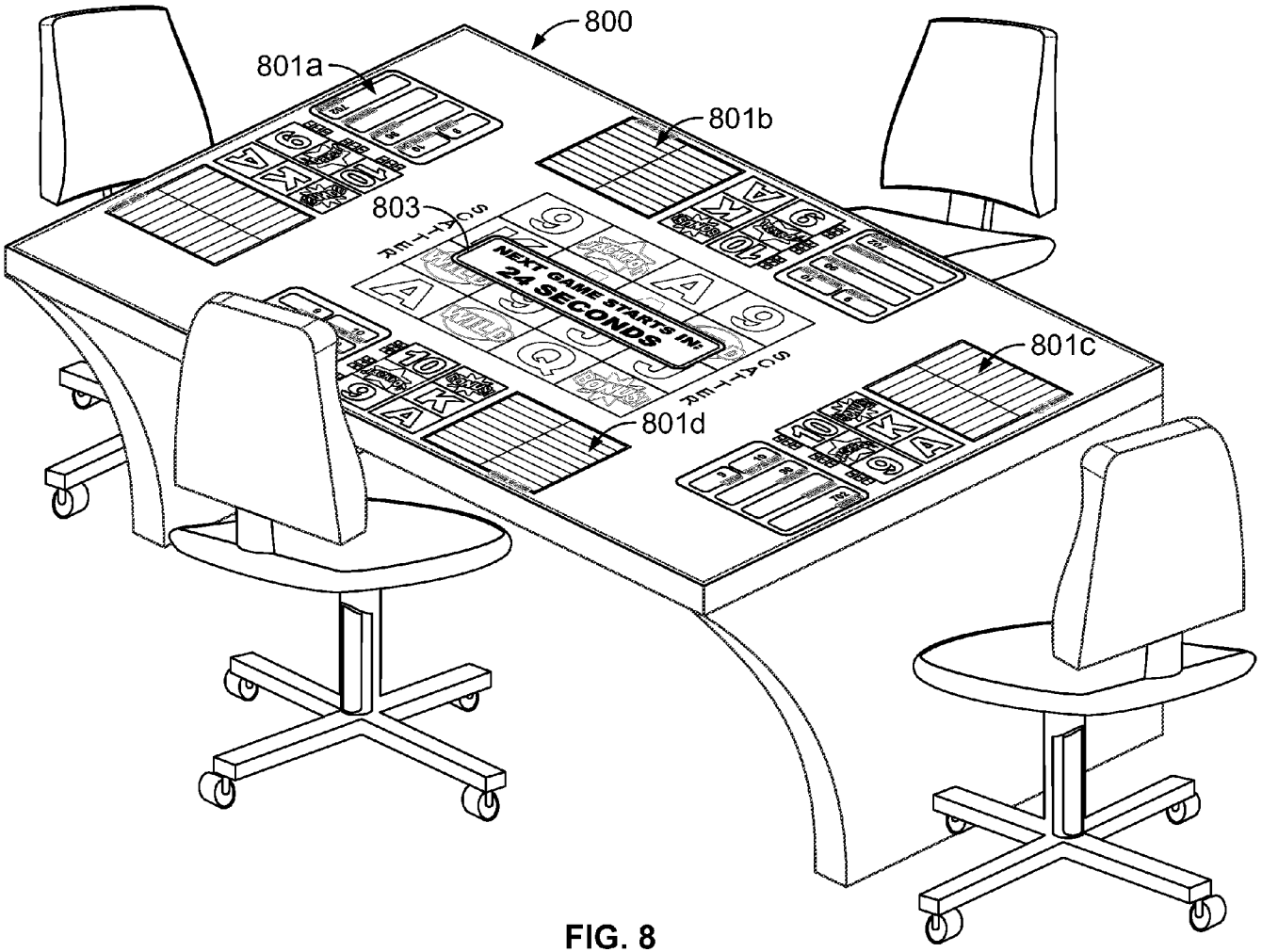
FIG. 8 is a view yet another alternative embodiment of a gaming system in which partial outcomes are queued, wherein the system comprises a gaming table.

Turning to FIG. 8, in addition to playing on a single machine the player may play at a community table 800, in which a plurality of players is seated around a video table displaying wagering games. In this embodiment each player spins from their own base reels 801*a*, 801*b*, 801*c*, 801*d* and the final outcome is determined by a spin of communal reels 803 in a singular communal game. Some players may choose to only spin once while other players may choose to spin as many times as possible until the spin of the communal reels 803 occurs. Some examples of applications for community spins may include a secondary community screen where the base game is either played using a machine or handheld device, a mechanical device such as a roulette wheel or dice, and an actual dealer. The community table 800 may comprise a plurality of displays which work in unison to generate the player reels 801*a, b, c, d* and the communal reels 803. Alternatively, the tabletop of the community table 800 may comprise a single display, such as a projection display, an LCD, plasma display, or other flat screen display. One or more input devices may be used, such as a multi-person touch screen system overlying the table top and capable of sensing inputs from a plurality of players simultaneously.

Figure 9:
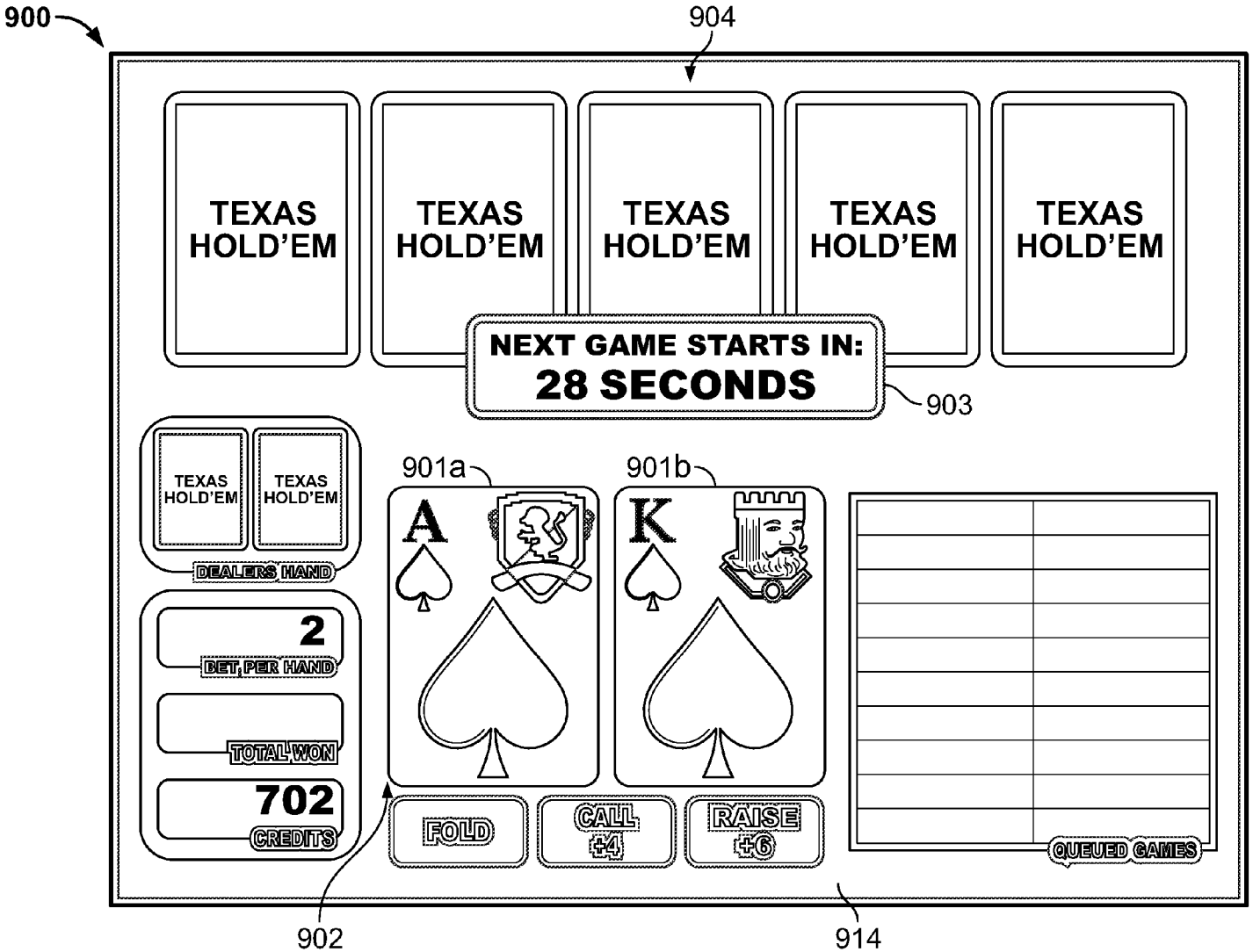
FIGS. 9-11 depict yet another embodiment of a gaming system in which partial outcomes are queued, the gaming system displaying playing cards.

Turning to FIG. 9, an embodiment depicts using queued partial outcomes for a poker game 900. In this example, a player "antes" 2 credits and is dealt two cards 901*a*, 901*b* that are displayed in an area 902 of the primary display 914. The player is prompted to fold, call for an additional two credits, or raise for an additional six credits. While the player is playing his two card hand 901*a*, 901*b*, a timer is counting down to the time when the second portion of the wagering game begins. A message box 903 states: "NEXT GAME STARTS IN: 28 SECONDS", and is overlaid on the secondary display 904.

Figure 10:
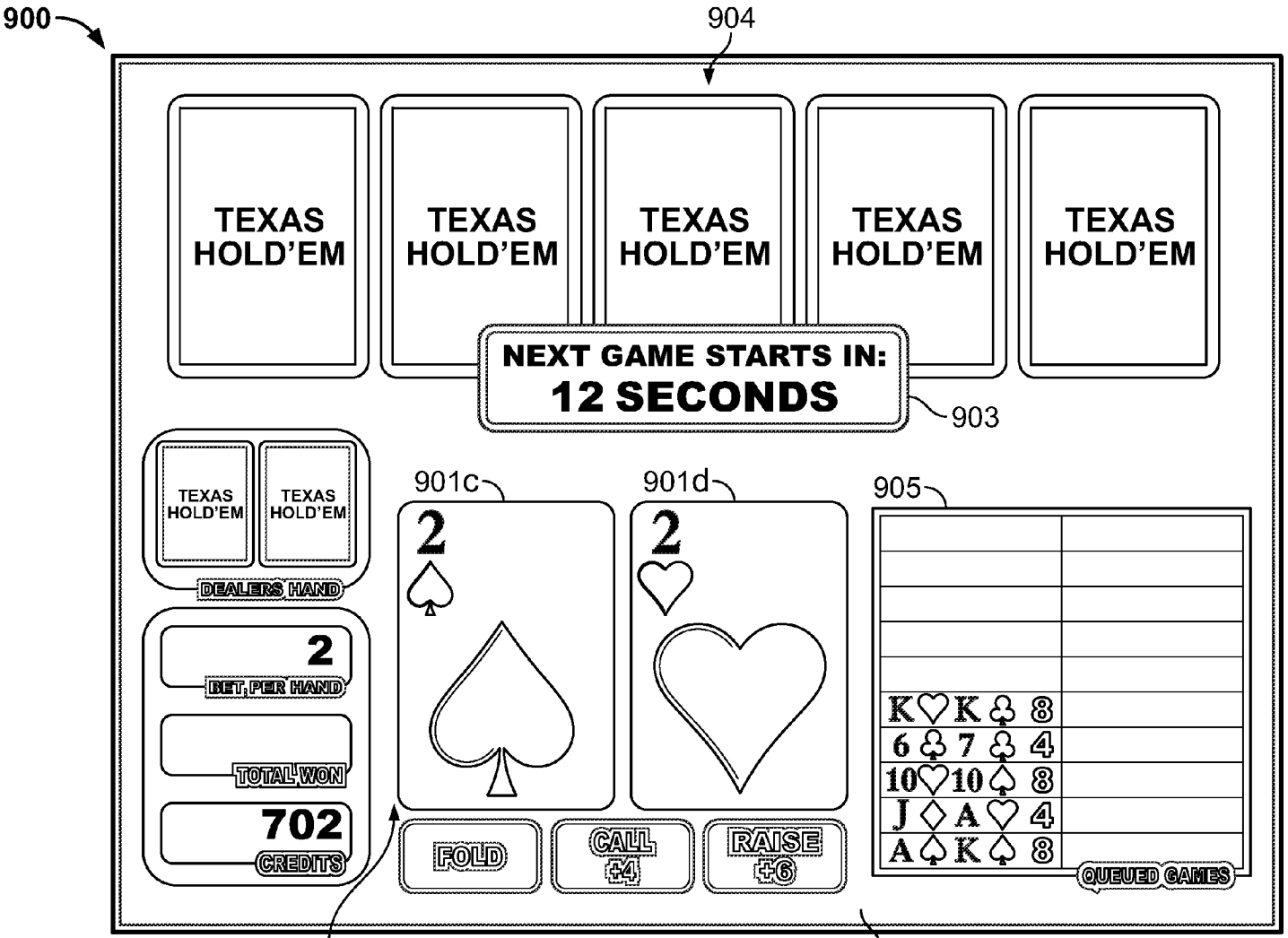

Turning to FIG. 10, in further game play the called and raised hands are queued in the table 905, along with the net wager for each saved hand (e.g. 4 or 8 credits). In this particular turn player "antes" 2 credits and is dealt 2 cards 901*c*, 901*d* that are displayed in a primary display 902. The player is prompted to fold, call for an additional credits, or raise for additional credits. While the player is playing the 2 cards 901*a*, 901*b*, a timer is counting down to the time when the second portion of the wagering game begins. A current time of the count down is displayed in a message box 903, which states: "NEXT GAME STARTS IN: 12 SECONDS", and is overlaid on the secondary display 904.

Figure 11:
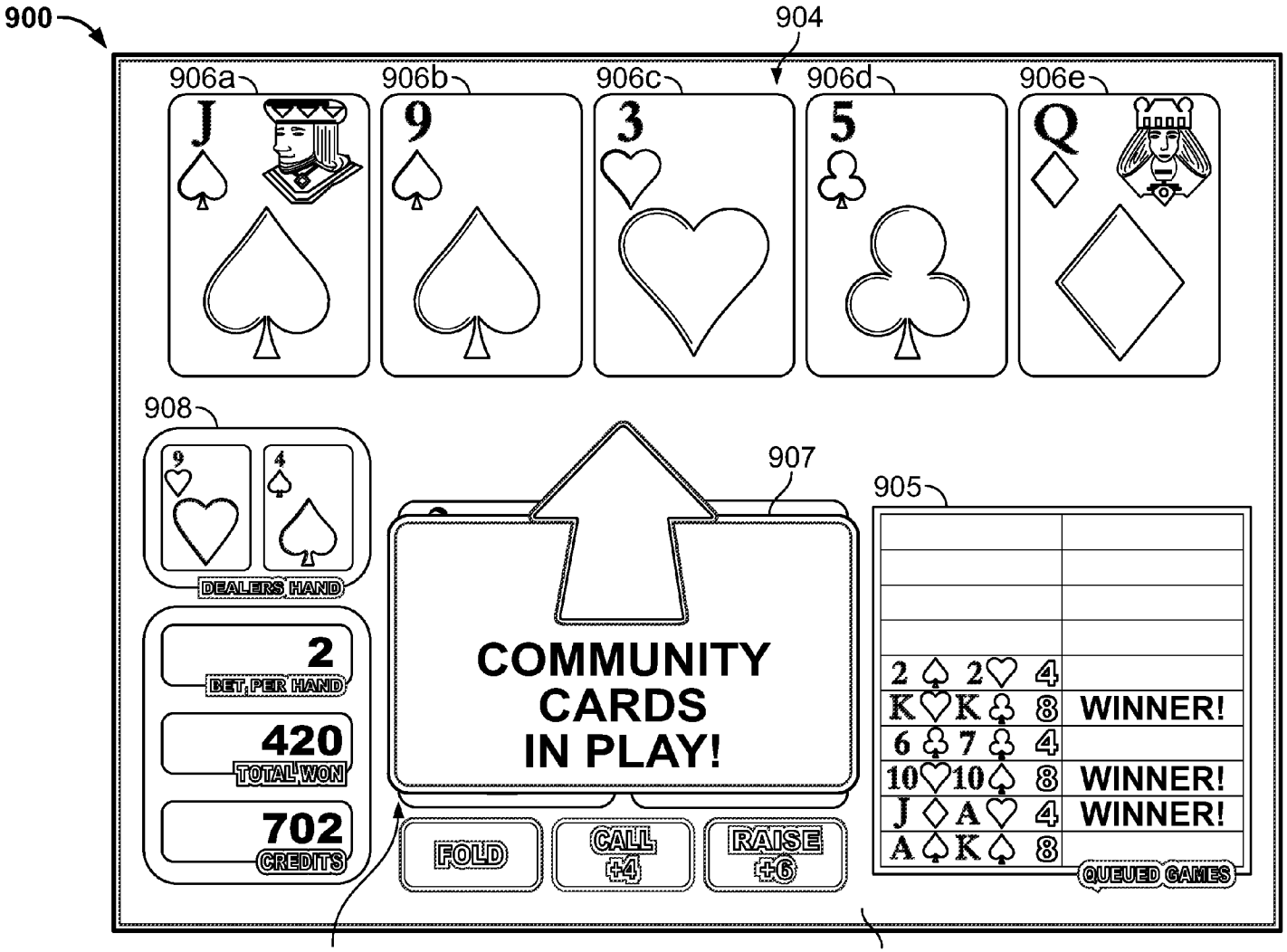

Turning to FIG. 11, a communal portion of the game is triggered. When it is time for the communal game to begin, a message box 907 is overlaid on the primary display 902 and indicates that the community cards 906*a, b, c, d, e* are in play. The community cards 906*a, b, c, d, e* are dealt and displayed in a second area 904 of the primary display 914 and the player is awarded for winning hands. The player's queued partial outcomes in table 905 are combined with the community cards 906 to create resulting poker hands for the player. The resulting poker hands are evaluated to determine whether they defeat the dealer's hand 908. In one embodiment, players are awarded for hands in accordance with a paytable. In other embodiments, players are awarded for defeating a dealer's hand 908. In yet other embodiments, awards may be based in part on both a paytable and whether or not the player beats the dealer's hand 908.

Figure 12:
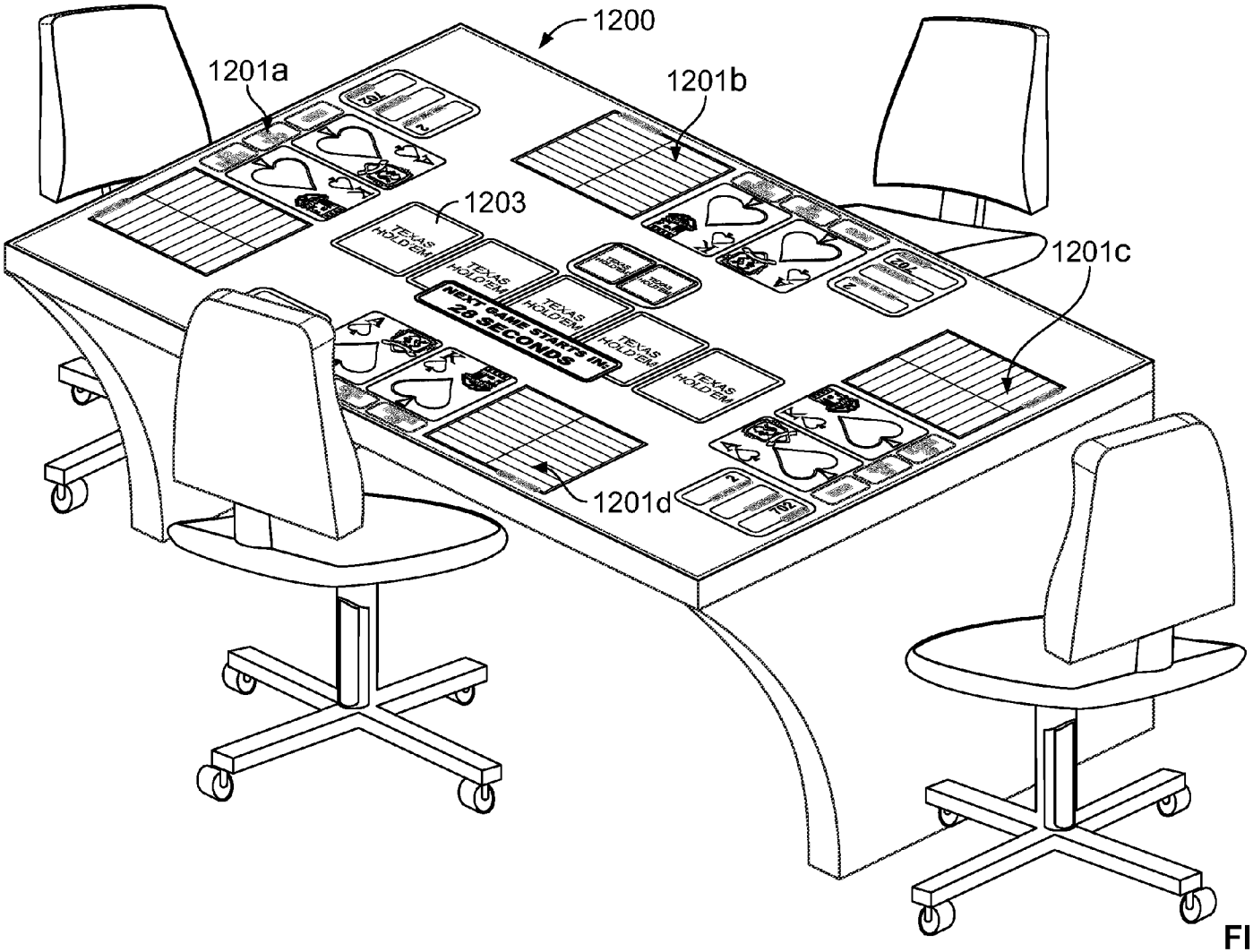
FIG. 12 is a view of the gaming system of FIGS. 9-11 wherein the gaming system comprises a community table on which the wagering game is depicted.

Turning to FIG. 12, an embodiment depicts the poker game of FIGS. 9-11 utilizing a community gaming table, such as a Multi-Touch Table 1200. Thus, in addition to playing on a single machine the player may play at the Multi-Touch Table 1200, in which a plurality of players is seated around a video table displaying wagering games. In this embodiment each player has a respective primary display 1201*a*, 1201*b*, 1201*c*, 1201*d* and the final outcome is determined by the community cards 1203 displayed in the secondary display 1202 in a singular communal game. The community table 1200 may comprise a plurality of displays which work in unison to generate the player and community portions of the game. Alternatively, the tabletop of the community table 1200 may comprise a single display, such as an LCD, plasma or other flat screen display. One or more input devices may be used, such as a multi-person touch screen system overlying the table top and capable of sensing inputs from a plurality of players simultaneously.

Thus, in general the embodiments according to the present method and apparatus provide and store (queue) multiple individual outcomes for each community outcome, wherein the player may be permitted to determine (at least to some degree) how many individual outcomes are provided for each community outcome. The community outcome may be combined with each of the individual outcomes to provide a combined outcome that is paid according to a pay table. For example, in one embodiment, the community outcome may be displayed at a fixed pace (e.g., every 45 seconds) and, prior to the display of each community outcome, the player may cause (by betting and pressing a spin button) the individual outcomes to be displayed at a pace of their choice prior to the display of each community outcome. The player effectively queues up as many individual outcomes as they wish (by how often the player wishes to bet and press the spin button) prior to the display of each community outcome.

In this embodiment, the sequence of events may be as follows:

1) clock starts counting down from 45 seconds;

2) player bets and spins individual reels as many times as they can and wish until the clock reaches zero, queued individual outcomes being displayed (or at least potential winning ones of the queued outcomes are displayed); and 3) when clock reaches zero, community reels are spun and player is awarded for each combined outcome according to a pay table.

The following are examples of alternative embodiments according to the present method and apparatus. Outcomes may be provided by other reel or poker card arrangements. Also, in the above described embodiments, the community outcome is provided after the partial or individual outcomes. This may be reversed according to the present method and apparatus, and the community outcome may be provided before the individual outcomes. Furthermore, in the above described embodiments the player provides the individual outcomes by pressing a button to spin the reels. Alternatively, the player may provide a more general instruction indicating how many individual outcomes they want for the associated community outcome. These individual outcomes may be displayed one at a time as in the above described embodiment, or all at once.

In yet other alternative embodiments, it should be understood that the queued partial outcomes of the first portion of the wagering game may be stored and used in association with multiple events rather than just a single event. For example, the partial outcomes stored in the table may be used for entry into multiple plays of a secondary game, or for entry in multiple types of secondary games. Moreover, the queued partial outcomes may be stored and used for different culminating events, such as the secondary games described herein. In another alternative embodiment, the queued partial outcomes may be stored and recalled for use at later times. For example, the queued partial outcomes may be stored in memory and associated with a player identifier, which may be used by a player to recall one or more of the stored partial outcomes for later use. Moreover, the stored queued partial outcomes may be printed on a ticket or other media, which can be reintroduced into the same or different gaming device for later recall. In yet other alternative embodiments, the triggering event which causes the entry of the queued partial outcomes into a secondary game may be player selectable or adjustable. For example, a player may select from a plurality of available triggering events, or may even be able to customize a triggering event to his own preferences. In yet other embodiments, a threshold triggering event may be configured so as to be triggered off of a single player's status, gaming activity, or gaming results, or alternatively, off of the combined or net status of a group of players, or their gaming results. Other embodiments may be configured as well.

In some embodiments of the present invention, the player is only provided an award for the highest award amount associated with a single one of the winning outcomes. This award amount is then multiplied by the total number of winning outcomes achieved by the player upon completion of the second portion of the wagering game. In alternative embodiments, the highest award amount may be multiplied by the entire quantity of queued outcomes.

Each of these embodiments and obvious variations thereof is contemplated as falling within the spirit and scope of the claimed invention, which is set forth in the following claims.

What is claimed is:

1. A method of operating a wagering game on a gaming system with an input device, a display device, and a processor, the method comprising:

receiving, via the input device, at least a first wager from at least a first player;

in response to receiving the first wager, determining, via the processor, and displaying, via the display device, a first partial outcome of a first play of the wagering game, the first partial outcome including a first plurality of symbols arranged on a plurality of symbol-bearing reels;

storing the first partial outcome;

receiving, via the input device, at least a second wager from the first player;

in response to receiving the second wager, determining, via the processor, and displaying, via the display device, a second partial outcome of a second play of the wagering game, the second partial outcome including a second plurality of symbols arranged on the plurality of symbol-bearing reels;

storing the second partial outcome;

upon expiration of a predetermined time period at the gaming system, determining and displaying a secondary outcome of the wagering game; and combining each of the stored first and second partial outcomes with the secondary outcome to determine, via the processor, and display, via the display device, a plurality of distinct final outcomes.

2. The method of claim 1, further comprising displaying in a table the first and second partial outcomes prior to displaying the secondary outcome.

3. The method of claim 1, further comprising awarding according to a pay table a respective award for each final outcome of the plurality of final outcomes that includes a respective winning outcome.

4. The method of claim 1, wherein the first and second partial outcomes are displayed on a primary display of a gaming machine, the secondary outcome is displayed on a community display of the gaming system, and the final outcomes are displayed on the primary display.

5. The method of claim 1, wherein the first and second wagers are received and the first and second partial outcomes are displayed within the predetermined time period.

6. The method of claim 1, wherein the first and second partial outcomes of the first and second plays of the wagering game are evaluated using a first number of paylines, and wherein the final outcomes from combining each of the partial outcomes with the secondary outcome are evaluated using a second number of paylines.

7. The method of claim 1, wherein the method further comprises accumulating one or more modifiers in the first play of the wagering game, and awarding further modifiers based on the one or more accumulated modifiers.

8. The method of claim 1, wherein the first play of the wagering game has the first plurality of symbols arranged in at least a first array, the second play of the wagering game has the second plurality of symbols arranged in at least the first array, and the secondary outcome of the wagering game has a third plurality of symbols arranged in at least a second array, and wherein the first and second partial outcomes of the wagering game are evaluated using one or more paylines passing through the first array, and the secondary outcome of the wagering game is evaluated based upon scatter pays.

9. The method of claim 1, further comprising:

receiving third and fourth wagers from a second player;

in response to receiving the third and fourth wagers from the second player, sequentially determining and displaying, via a second display device distinct from the display device, third and fourth partial outcomes of third and fourth plays of the wagering game;

storing the third and fourth partial outcomes; and combining each of the third and fourth partial outcomes with the secondary outcome to determine and display a second plurality of distinct final outcomes for the second player.

10. The method of claim 1, wherein, after the first partial outcome is displayed and stored, the plurality of symbol-bearing reels are displayed spinning and stopping to reveal the second partial outcome of the second play of the wagering game.

11. The method of claim 1, further comprising:

determining whether each of the partial outcomes of the wagering game comprises to at least one winning partial outcome;

combining only respective ones of the partial outcomes that comprise at least one winning partial outcome with the secondary outcome to determine and display the plurality of distinct final outcomes; and determining whether each of the final outcomes comprises at least one winning final outcome.

12. The method of claim 1, wherein the determining and displaying of the first and second partial outcomes comprises determining and displaying only the first partial outcome and subsequently determining and displaying only the second partial outcome.

13. The method of claim 1, wherein a total number of partial outcomes that are determined and displayed is selected by a player.

14. A gaming system comprising:

a wager input device;

at least one display configured to display a primary wagering game; and at least one controller operative to:

detect receipt of at least a first wager from a first player via the wager input device;

in response to detecting the first wager, determine and display a first partial outcome of a first play of the wagering game, the first partial outcome including a first plurality of symbols arranged on a plurality of symbol-bearing reels;

store the first partial outcome;

detect receipt of at least a second wager from the first player via the wager input device;

in response to detecting the second wager, determine and display a second partial outcome of a second play of the wagering game, the second partial outcome including a second plurality of symbols arranged on the plurality of symbol-bearing reels;

store the second partial outcome;

upon expiration of a predetermined time period, determine and display a secondary outcome of the wagering game; and combine each of the stored first and second partial outcomes with the secondary outcome to determine and display a plurality of distinct final outcomes.

15. The system of claim 14, wherein the secondary outcome of the wagering game includes a plurality of symbols arranged on a second plurality of symbol-bearing reels distinct from the plurality of symbol-bearing reels.

16. The system of claim 14, wherein the at least one controller is further operative to determine one of a losing outcome and a winning outcome for each of the final outcomes according to a predetermined rule set.

17. The system of claim 16, wherein the at least one controller is further operative to award according to the predetermined rule set a respective award if a respective final outcome of the plurality of final outcomes is a winning outcome, the respective award being displayed in an award display.

18. The system of claim 14, wherein the plurality of symbol-bearing reels and the first and second partial outcomes are displayed on at least one individual display of a gaming machine, the secondary outcome is displayed on a community display of the gaming system remote and separate from the at least one individual display, and the final outcomes are displayed on the at least one individual display.

19. The system of claim 14, wherein the predetermined time period is displayed via the at least one display.

20. The system of claim 14, wherein the first and second partial outcomes of the first and second plays of the wagering game are evaluated using a first number of paylines, and wherein the final outcomes from combining each of the partial outcomes with the secondary outcome are evaluated using a second number of paylines.

21. The system of claim 14, wherein the first play of the wagering game has the first plurality of symbols arranged in at least a first array, the second play of the wagering game has the second plurality of symbols arranged in at least the first array, and the secondary outcome of the wagering game has a third plurality of symbols arranged in at least a second array, and wherein the first and second partial outcomes of the wagering game are evaluated using one or more paylines passing through the first array, and the secondary outcome of the wagering game is evaluated based upon scatter pays.

22. A method of conducting a wagering game on a gaming system with one or more input devices and one or more processors, the method comprising:

receiving, via the one or more input devices, a plurality of wagers;

in response to receiving a first one of the plurality of wagers, determining, via the one or more processors, and storing a first individual outcome of a first play of the wagering game, the first individual outcome being configured to combine with a community outcome;

in response to receiving a second one of the plurality of wagers, determining, via the one or more processors, and storing a second individual outcome of a second play of the wagering game, the second individual outcome being distinct from the first individual outcome and being configured to combine with the community outcome;

displaying the individual outcomes via a primary display;

determining, via the one or more processors, and displaying, via a community display, the community outcome;

combining the community outcome with each of the distinct individual outcomes to provide multiple distinct combined outcomes; and evaluating each of the multiple distinct combined outcomes for winning symbol combinations utilizing a pay table of the wagering game.

23. The method of claim 22, wherein a player determines how many individual outcomes are determined and stored for the community outcome.

24. The method of claim 22, wherein the community outcome is displayed after the individual outcomes.

25. The method of claim 22, wherein the individual outcomes are displayed after the community outcome.

26. The method of claim 22, wherein a selectable number of individual outcomes are determined and displayed prior to the determination and display of the community outcome.

27. The method of claim 22, wherein a number of individual outcomes is selected, and wherein the communal outcome is determined and displayed after all of the number of individual outcomes are determined and displayed.

* * * * *